US010307903B2

(12) United States Patent
Reed

(10) Patent No.: US 10,307,903 B2
(45) Date of Patent: Jun. 4, 2019

(54) SIDING ADAPTOR FOR NAIL GUNS

(71) Applicant: Philip M. Reed, Leola, PA (US)

(72) Inventor: Philip M. Reed, Leola, PA (US)

( * ) Notice: Subject to any disclaimer, the term of this patent is extended or adjusted under 35 U.S.C. 154(b) by 0 days.

(21) Appl. No.: 15/893,413

(22) Filed: Feb. 9, 2018

(65) Prior Publication Data

US 2018/0229354 A1 Aug. 16, 2018

Related U.S. Application Data

(60) Provisional application No. 62/457,312, filed on Feb. 10, 2017.

(51) Int. Cl.

| | |
|---|---|
| ***E04B 1/00*** | (2006.01) |
| ***B25C 7/00*** | (2006.01) |
| ***E04F 13/18*** | (2006.01) |
| ***E04F 13/08*** | (2006.01) |
| ***E04F 21/18*** | (2006.01) |
| *E04F 21/00* | (2006.01) |

(52) U.S. Cl.

CPC ..... *B25C 7/00* (2013.01); *E04F 13/0864* (2013.01); *E04F 13/18* (2013.01); *E04F 21/1855* (2013.01); *E04F 21/00* (2013.01)

(58) Field of Classification Search

CPC ..... B25C 7/00; E04F 13/0864; E04F 21/00; E04F 13/18

USPC ..... 52/748.11; 227/119, 107

See application file for complete search history.

(56) References Cited

U.S. PATENT DOCUMENTS

| | | | | |
|---|---|---|---|---|
| 3,542,273 | A | 11/1970 | Granville | |
| 3,854,648 | A * | 12/1974 | Inzoli | B25C 1/003 227/130 |
| 5,484,094 | A * | 1/1996 | Gupta | B25C 1/18 227/113 |
| 5,649,661 | A | 7/1997 | Masuno | |
| 5,743,455 | A | 4/1998 | Holliday | |
| 6,279,808 | B1 * | 8/2001 | Larsen | B25C 1/00 227/119 |
| 6,393,711 | B1 | 5/2002 | Freund | |
| 6,676,001 | B1 * | 1/2004 | Chen | B25B 23/045 227/119 |
| 6,776,322 | B2 | 8/2004 | Villela | |
| 6,880,741 | B2 | 4/2005 | Gill | |
| 7,017,790 | B1 * | 3/2006 | Peng | B25C 1/188 227/107 |

(Continued)

*Primary Examiner* — Basil S Katcheves

(74) *Attorney, Agent, or Firm* — Miller Law Group, PLLC

(57) ABSTRACT

An adaptor is mounted on the tip of a nail gun normally used to attach roofing materials on the roof of a building to enable the nail gun also to be effective in attaching vinyl siding onto the exterior of a building structure. The adapter is mounted on the tip of the nail gun to engage nails discharged therefrom. The adaptor is formed with a circular projection that has a frusto-conical opening therethrough to guide discharged nails into engagement with the connective structure along the top edge of the siding panel. The circular projection has a depth that properly positions the discharge opening of the adaptor at the proper location for engagement with the siding connective structure. The conical shape of the opening through the adaptor is operable to deflect any misaligned nails being discharged from the nail gun into the discharge opening at the tip of the circular projection.

10 Claims, 5 Drawing Sheets

(56) References Cited

U.S. PATENT DOCUMENTS

| | | | | |
|---|---|---|---|---|
| 7,055,728 | B2 * | 6/2006 | Lin | B25C 7/00 227/110 |
| 7,066,371 | B2 | 6/2006 | Villela | |
| 7,255,256 | B2 * | 8/2007 | McGee | B25C 1/041 227/119 |
| 7,565,992 | B2 * | 7/2009 | Buetow | B25C 7/00 227/110 |
| 8,056,785 | B2 * | 11/2011 | Gosis | B25C 7/00 227/140 |
| 8,695,860 | B2 | 4/2014 | Wang | |
| 2004/0011845 | A1 * | 1/2004 | Walter | B25C 7/00 227/120 |
| 2007/0215668 | A1 * | 9/2007 | Tabacco | B25C 7/00 227/107 |

* cited by examiner

Fig. 4
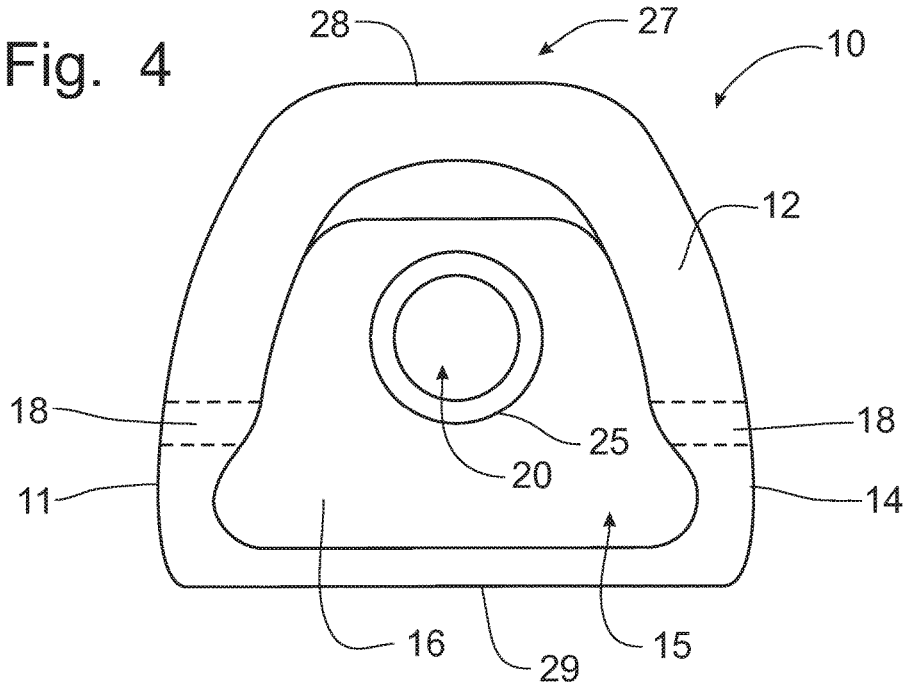
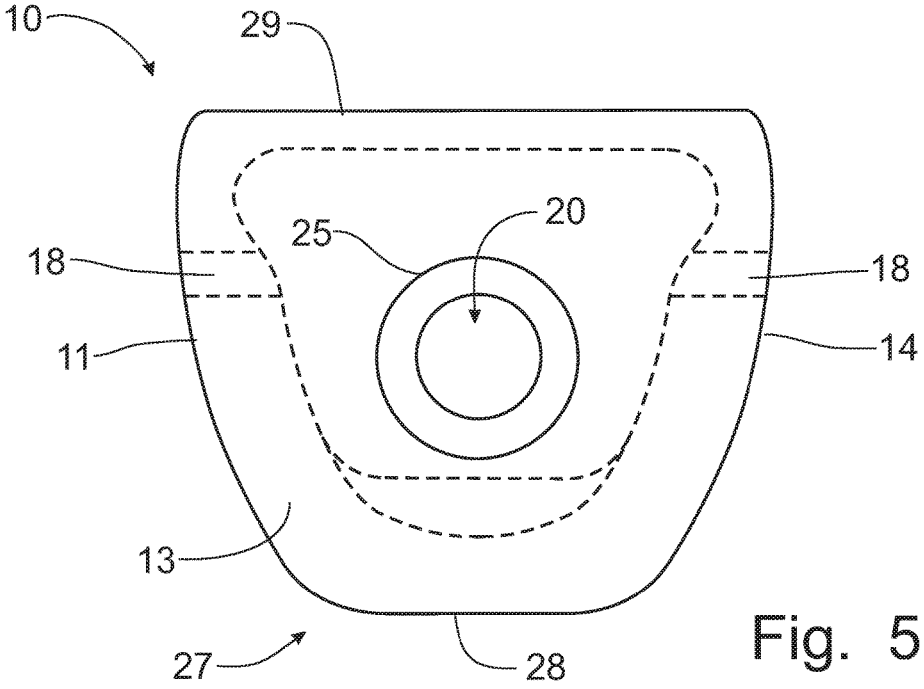
Fig. 5

Fig. 6
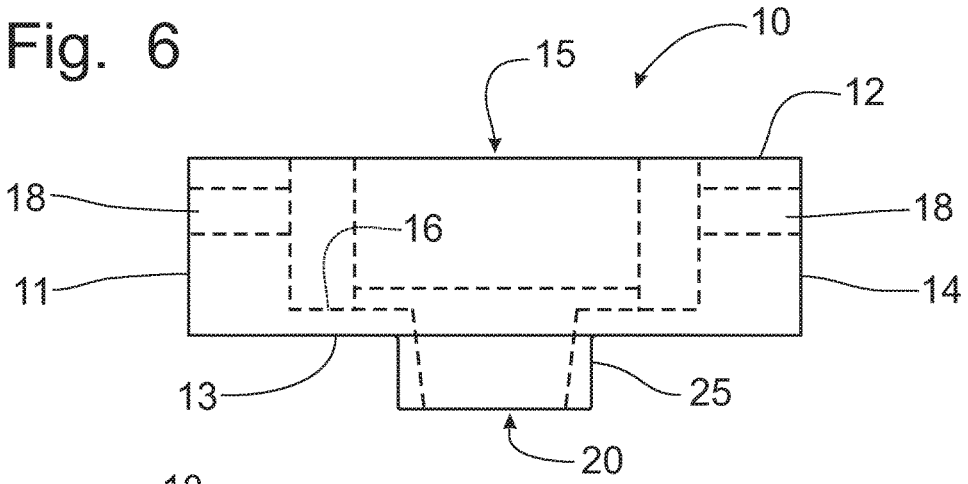
Fig. 7
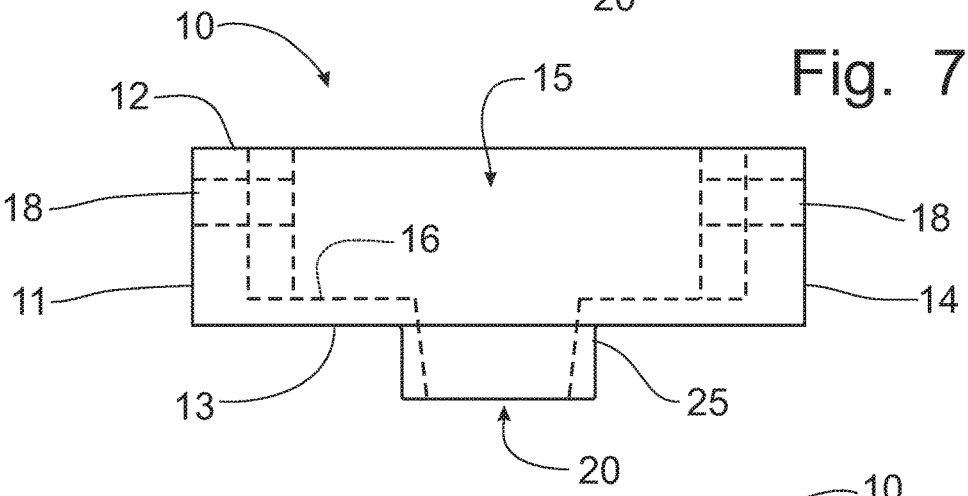
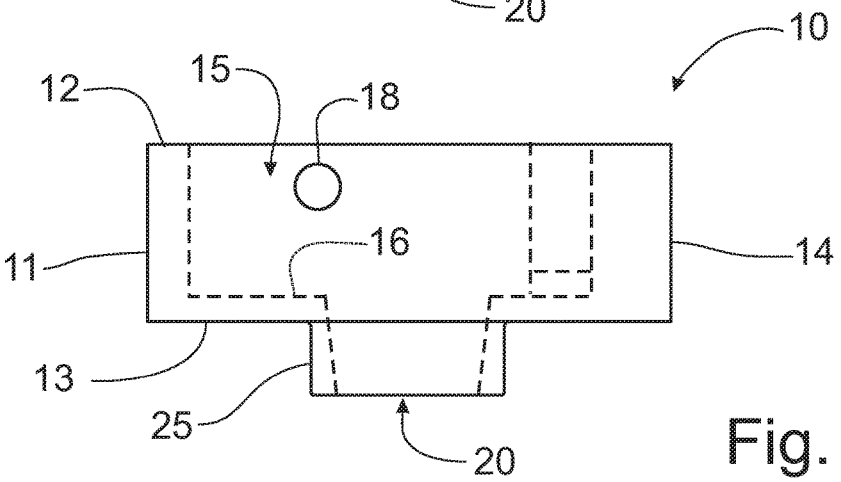
Fig. 8

SIDING ADAPTOR FOR NAIL GUNS

CROSS-REFERENCE TO RELATED APPLICATIONS

This application claims domestic priority on U.S. Provisional Patent Application Ser. No. 62/457,312, filed on Feb. 10, 2017, the content of which is incorporated herein by reference.

FIELD OF THE INVENTION

This invention deals generally with the use of a nail gun to attach vinyl siding to the side of a building structure and, more specifically, to an adaptor that is detachably mounted on the tip of the nail gun to align and position the discharge point of the nail gun in a consistent manner to permit the nail gun to be used to attach vinyl siding to the side of a building.

BACKGROUND OF THE INVENTION

Nail guns are powered devices that project a nail through the tip of the nail gun into an external structure. Most nail guns are powered through compressed air, but nail guns can also be electrically driven. The nail gun holds a supply of nails in a magazine to be presented one at a time in a chamber to be driven from the chamber into the external structure. In the configuration schematically depicted in FIG. 1, the nail gun 1 has a supply of nails 2 arranged in an array in the magazine 3 with the endmost nail 2 positioned in the chamber 4. A piston 5, powered by compressed air connected to the compressed air port 6 of the nail gun 1 when the trigger 7 is pulled, drives the nail 2 out of the chamber into the structure that is positioned adjacent the tip 8 of the nail gun 1. After driving the nail 2 from the chamber 4, the piston 5 returns to the retracted position and the spring-loaded magazine pushes the next nail 2 into the chamber 4 to repeat the process.

In the way of examples, the nail gun can be used effectively to nail shingles to the outer surface of a roof on a building or to nail plywood to the frame structure of the building, whether that is the roof or an exterior wall. The nail gun provides an effective and efficient manner in which two members can be joined together with nails driven at a high rate of speed from the tip of the nail gun. However, the tip of the nail gun needs to be positioned adjacent one of the external members to be joined together to control the movement of the nail as the nail leaves the tip of the nail gun. Accordingly, there are some situations in the building trades where the nail gun cannot be effectively used, primarily because the tip of the nail gun cannot be positioned at the appropriate location for the application of the nail into the structure.

The attachment of siding, such as vinyl siding, to the exterior of a building structure is one such situation where the nail gun has not been used effectively. Vinyl siding 9, as schematically depicted in FIG. 1, has a connective structure 9*a* along the top edge of the siding panel 9 that is configured to engage with the mating connective structure 9*b* at the bottom edge of the siding panel 9. To attach siding 9 to the underlying exterior wall 9*c* of a building structure, each siding panel 9 is connected to the siding panel 9 below by interengaging the connective structures 9*a*, 9*b* and then nailing the upper edge of the siding panel 9 to the underlying exterior wall 9*c*. The space provided within the upper connective structure 9*a* along the upper edge of the siding panel 9 is too small and non-cooperatively positioned to position the tip 8 of the nail gun 1 into the space for the application of a nail from the nail gun 1. Accordingly, the conventional manner in which vinyl siding 9 is placed on an exterior wall 9*c* of a building is to manually nail the siding panels 9 to the exterior wall 9*c*.

Nail gun configurations vary from one manufacturer to another, but all operate on the same general principle of having a magazine filled with nails to deliver a nail to a driving tool which when activated powers the nail out of the nail gun into the underlying, adjacent structure. One nail gun configuration is shown in U.S. Pat. No. 3,542,273, issued on Nov. 24, 1970, to Granville R. Hedrick, in which the nail gun is actuated by striking an impact blow to the end of the nail gun. The nail gun shown in U.S. Pat. No. 5,649,661, issued to Takayuki Masuno Kazuhiko on Jul. 22, 1997, is a more conventional nail gun powered by compressed air, but having a detachable contact foot mounted on the tip of the nail gun. In U.S. Pat. No. 8,695,860, issued to Jing-Li Wang, et al., a nail guiding structure forms a part of the nail gun structure to improve the performance thereof to deliver nails to underlying, adjacent structure.

Adaptors for use with nail guns to accomplish certain functions are known in the art, as can be found in U.S. Pat. No. 6,776,322, granted on Aug. 17, 2004, and in U.S. Pat. No. 7,066,371, granted on Jun. 27, 2006, both to Edward C. Villela, et al. In the Villela patents, the depth control spacer is placed on the tip of the nail gun to control the depth of penetration of the discharged nails into the structure adjacent thereto. The Villela depth control spacer is operable for use in to two or more layers of roofing material which contain a layer of compressible fibrous material wherein the depth control spacer prevents the fibrous layer from being permanently compressed. Another depth control adaptor is shown in U.S. Pat. No. 5,743,455, granted on Apr. 28, 1998, to Brett Holliday. An adaptor is disclosed in U.S. Pat. No. 6,880,741, issued on Apr. 19, 2005, to Donald C. Gill to facilitate the use of the nail gun having a cylindrical magazine in the nailing of replacement shingles on a building roof.

The adaptor disclosed in U.S. Pat. No. 6,393,711, issued on May 28, 2002, to Todd Freund is intended to facilitate the use of the nail gun to nail siding panels on the exterior wall of a building structure. The Freund adaptor is detachably mounted on the frame of the nail gun and is elongated to cover the discharge tip of the nail gun. The Freund adaptor has an oval-shaped opening to permit the passage of the discharged nail from the nail gun tip through the adaptor, and has an elongated guide member that sits along an upper lip of the siding panel so that the nail is discharged into the siding panel at the same height from the lip each time the nail gun is actuated.

The Freund adaptor does nothing to locate the discharge point of the adaptor or the tip of the nail gun closer to the point of insertion of the nail into the siding panel. Accordingly, the Freund adaptor suffers from the same problems associated with the use of nail guns to fasten siding panels in that the depth control of the inserted nail cannot be satisfactorily controlled. All the Freund adaptor accomplishes is to consistently position the discharge point of the nail gun at a selected height above the upper lip of the siding panel on which the elongated guide member is positioned.

It would be desirable to provide an improved adaptor for use with a nail gun that will permit the nail gun to be utilized in a consistent manner for the nailing of vinyl siding to the exterior wall of a building structure.

SUMMARY OF THE INVENTION

It is an object of this invention to overcome the disadvantages of the prior art by providing an adaptor that can be mounted on the tip of a nail gun to facilitate the use of the nail gun to attach vinyl siding to the exterior of a building structure.

It is another object of this invention to provide a detachable adaptor member that can be selectively mounted on a nail gun when the use of the nail gun is needed to attach vinyl siding to the exterior of a building structure.

It is a feature of this invention that a nail gun typically used to attach roofing materials to the roof of a building structure can also be effectively utilized to attach vinyl siding to the exterior of the building structure.

It is another feature of this invention that the adaptor is formed with a circular projection that can serve as both a guide member that locates the discharge point of the adaptor and also locates the distal end of the circular projection adjacent a siding panel.

It is still another feature of this invention that the circular projection of the adaptor is formed with an opening therethrough for the passage of a nail from the nail gun into the vinyl siding.

It is an advantage of this invention that the opening through the adaptor is formed in a frusto-conical shape with the smaller diameter of the opening adjacent the siding panel to accurately and consistently position the discharged nail into the siding.

It is another advantage of this invention that the adaptor provides a consistent point relative to the position of the upper lip of the siding to insert a nail to attach the siding panel to the building frame.

It is still another advantage of this invention that the conical surface of the frusto-conical opening through the adaptor is operable to deflect a misaligned discharged nail sufficiently to enable the nail to pass through the smaller opening into engagement with the siding panel.

It is yet another advantage of this invention that the depth of the circular projection places the distal tip of the circular projection against the siding panel at the position where the insertion of the nail discharged from the nail gun is desired.

It is still another feature of this invention that the depth of penetration of the nail discharged from a nail gun into the underlying building structure is uniform, consistent and accurate each time the nail gun is actuated.

It is still another object of this invention to improve the efficiency of mounting vinyl siding on the exterior of a building structure by permitting the use of a standard nail gun to provide the nailing function, thus requiring less human energy to perform, increasing the speed and efficiency of the nailing process, improving performance and reducing costs.

It is yet another feature of this invention that the adaptor is provided with a pair of set screws to secure the adaptor on the tip of a nail gun.

It is yet another object of this invention to provide an adaptor for mounting on a nail gun to permit the nail gun to be used effectively for the attachment of vinyl siding to the exterior structure of a building wherein the adaptor is durable in construction, inexpensive of manufacture, carefree of maintenance, easy to mount and assemble on a nail gun, and simple and effective in use.

These and other objects, features and advantages are accomplished according to the instant invention by providing an adaptor for mounting on the tip of a nail gun normally used to attach roofing materials on the roof of a building to enable the nail gun to be effective in attaching vinyl siding onto the exterior of a building structure. The adapter is formed to mount on the tip of the nail gun to engage nails discharged therefrom. The adaptor is formed with a circular projection that has a frusto-conical opening therethrough to guide discharged nails into engagement with the connective structure along the top edge of the siding panel. The circular projection has a depth that properly positions the discharge opening of the adaptor at the proper location for engagement with the siding connective structure. The conical shape of the opening through the adaptor is operable to deflect any misaligned nails being discharged from the nail gun into the discharge opening at the tip of the circular projection.

BRIEF DESCRIPTION OF THE DRAWINGS

FIG. 4 is a top plan view of the adaptor, the flat front portion being at the lower part of the figure;

FIG. 5 is a bottom plan view of the adaptor, the recess into the upper side of the adaptor being shown in dashed lines, the flat front portion of the adaptor being at the top of the figure;

FIG. 6 is a rear elevational view of the adaptor, the recess into the body of the adaptor being shown in dashed lines;

FIG. 7 is a front elevational view of the adaptor, the recess into the body of the adaptor being shown in dashed lines; and FIG. 8 is a left side elevational view of the adaptor with the recess into the body of the adaptor being shown in dashed lines.

DETAILED DESCRIPTION OF THE PREFERRED EMBODIMENT

Looking now at the drawings, an adaptor incorporating the principles of the instant invention and being detachably mounted on the discharge tip of a nail gun 1 can best be seen. The adaptor 10 is a unitary structure that is selectively attached to the discharge tip 8 of a nail gun 1 to facilitate the use of the nail gun 1 to attach siding 9, such as vinyl siding, to the exterior walls of a building structure 9*c*. When the nail gun 1 is intended for use for a function other than attaching siding 9 to a building structure 9*c*, the adaptor 10 can be removed from the nail gun 1 and stored until subsequently needed.

Figure 1:
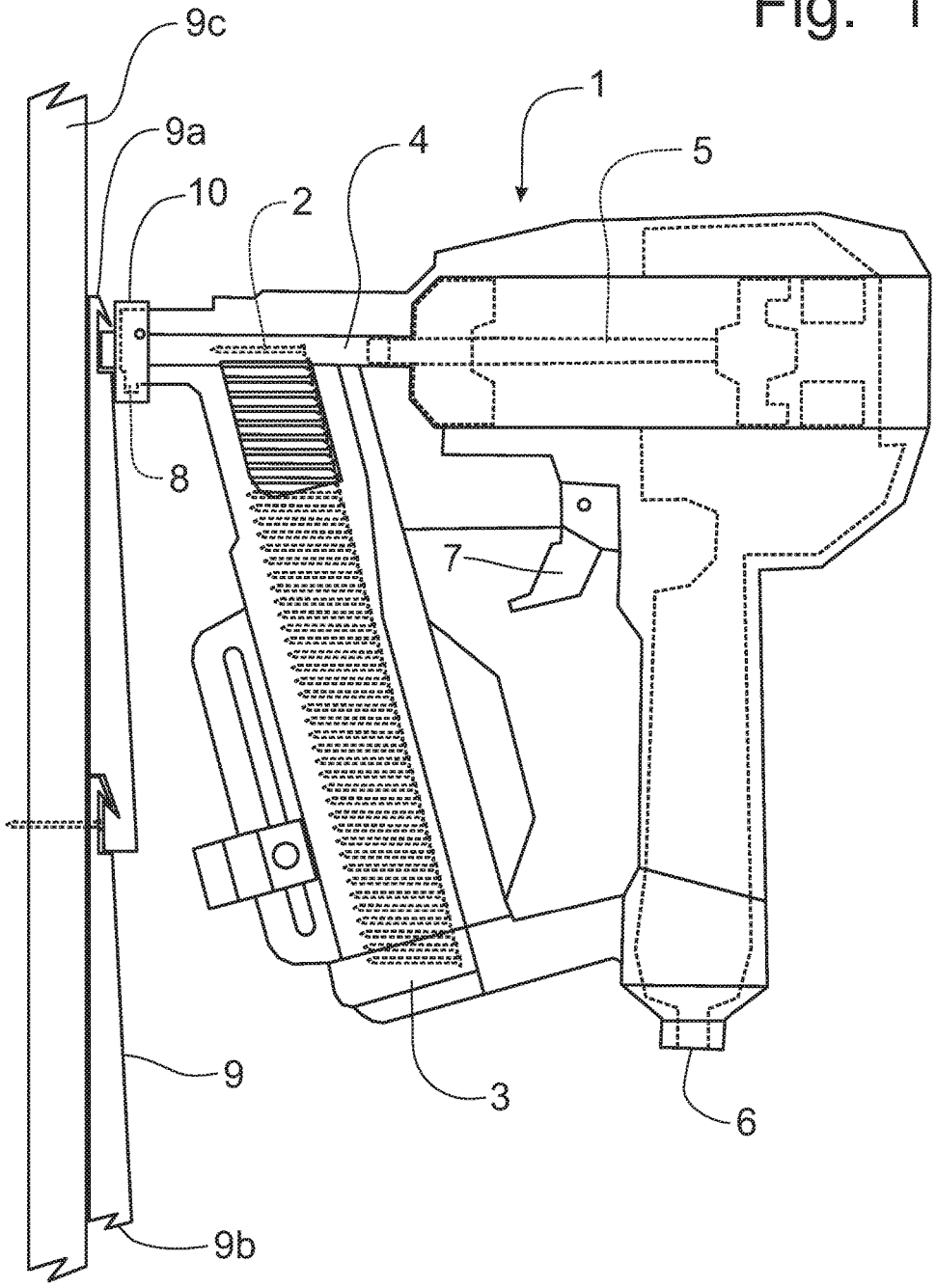
FIG. 1 is a schematic side elevational view of a conventional nail gun schematically depicted and provided with an adaptor incorporating the principles of the instant invention to permit the use of the nail gun to attach vinyl siding panels, schematically shown, to the exterior side of a building structure.
Figure 2:
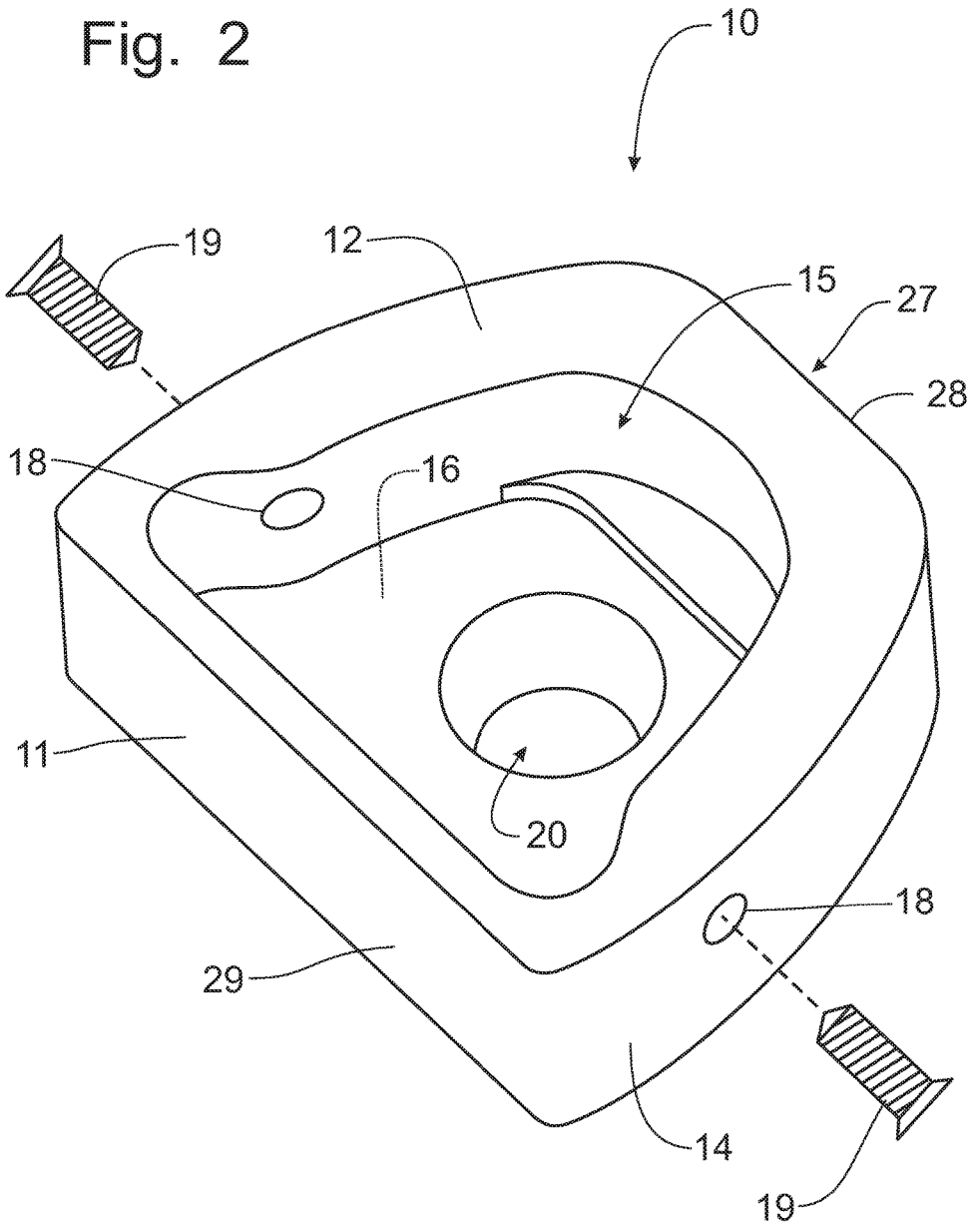
FIG. 2 is an upper, left front perspective view of an adaptor incorporating the principles of the instant invention, representative set screws for securing the adaptor onto the tip of a nail gun being schematically shown.
Figure 3:
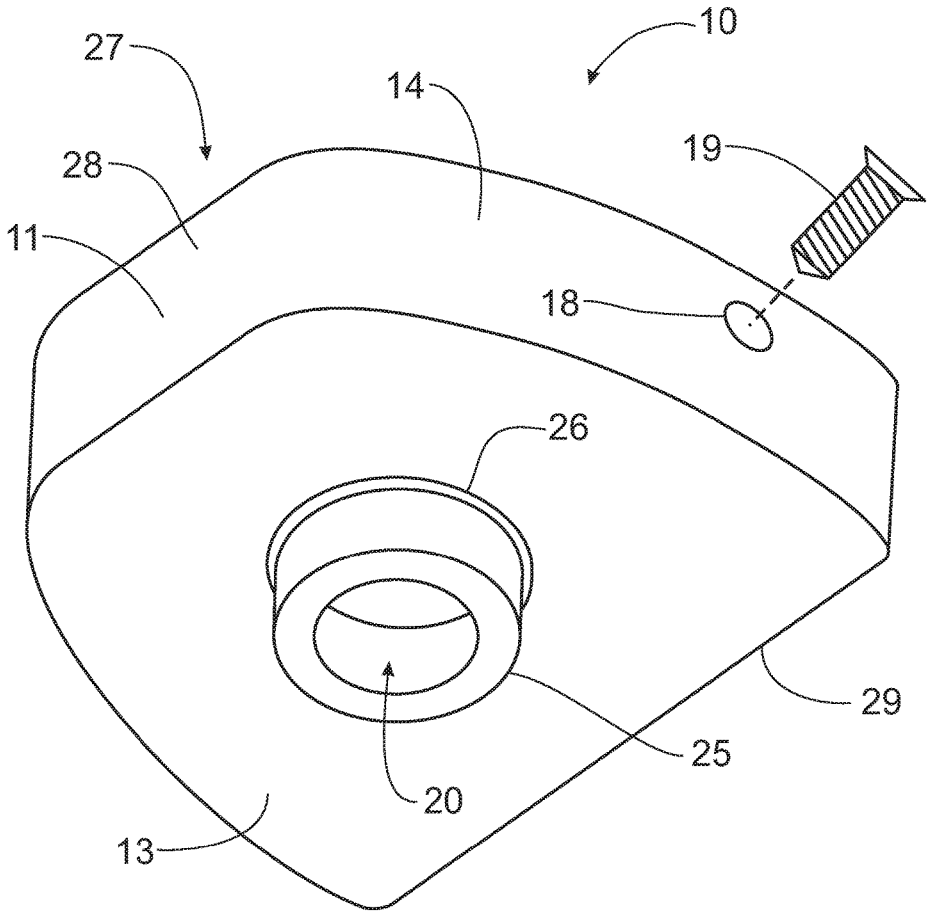
FIG. 3 is a rear, lower right perspective view of the adaptor shown in FIG. 2.

FIG. 1 is a schematic representation of a nail gun 1 having the adaptor 10 mounted thereon to permit consistent usage in the attachment of siding 9, schematically depicted, to a building exterior. Referring now to FIGS. 2-8, the adaptor 10 can best be seen. The adaptor 10 includes a unitary body 11 preferably formed from a durable rigid material, such as steel, that has a top surface 12, a bottom surface 13 and a vertical side wall 14 defining the perimeter of the body 11. A recess 15 is machined into the top surface 12 to receive the tip 8 of the nail gun 1. One of ordinary skill in the art will recognize that each adaptor 10 would preferably be configured to mate with the tip 8 of each different manufacturer's nail gun 1. Thus, the recess 15 is preferably formed to fit in a mating relationship to the nail gun tip 8 with the floor 16 of the recess 15 fitting against the nail gun tip 8.

The vertical side wall 14 is formed with a pair of opposing threaded horizontal openings 18 that pass from the side wall 14 into the recess 15. Each opening 18 is configured to receive a set screw 19 that is threaded into the corresponding opening 18 to secure the adaptor 10 onto the tip 8 of the nail gun 1. When properly secured, the discharge opening of the nail gun tip 8 is aligned with the vertical discharge opening 20 of the adaptor 10 to permit the passage of the discharged nail 2 through the opening 20 and into engagement with the siding 9 to be attached to the building. Preferably, the vertical discharge opening 20 is formed as a frusto-conical shape with the smaller diameter of the opening 20 being at the distal end of the opening 20.

The larger diameter of the opening 20 at the floor 16 of the recess 15 is preferably larger in diameter than the discharge opening in the tip 8 of the nail gun 1, while the smaller diameter of the opening 20 at the distal end of the projection 25 is approximately the same as the discharge opening in the tip 8 of the nail gun 1. The conical shape of the opening 20 will direct any slightly misaligned nails 2 discharged from the nail gun 1 into the vertical opening 20 to be directed to a specific point of contact aligned with the smaller diameter of the opening 20 into engagement with the siding 9, so that the adaptor 10 delivers a consistently placed nail into the siding 9.

As best seen in FIGS. 3-8, the bottom surface 13 of the body 11 is formed with a circular projection 25 projecting downwardly from the bottom surface 13. This circular projection 25 has a height dimension measured downwardly from the bottom surface 13 that is substantially equal, but slightly less than, the depth of the upper lip of the siding panel 9. The distal face of the projection 25 is preferably not placed in contact with the siding 9 during operation, but spaced slightly therefrom. The circular projection 25 corresponds to the vertical discharge opening 20 and has a wall thickness adequate to allow the formation of the vertical discharge opening 20 in a frusto-conical shape.

Therefore, the circular projection 25 can serve as both a guide member that locates the discharge point of the adaptor 10, and thus the nail gun 1, at a consistent point relative to the position of the upper lip of the siding 9, and also locates the distal end of the circular projection 25 and the smaller diameter of the opening 20 adjacent the siding panel 9 to accurately and consistently position the discharged nail 2 into the siding 9. The diameter of the circular projection 25 is approximately equal to twice the distance between the upper lip, or flange, of the siding 9 and the location at which the nails are to be placed to attach the siding 9 to the building structure. The circular projection 25 can be an integral part of the body 11 and thus formed by machining the body 11. Alternatively, the circular projection 25 can be welded to the bottom surface 13 of the body as is represented by the weld bead 26 in FIG. 3.

To conform to the shape of the tips 8 of most nail guns 1, the rearward end 27 of the adaptor 10 is preferably formed in a rounded shape and can have a flat nose 28 to provide a pleasing aesthetic appearance and to facilitate the proper orientation of the adaptor 10 when mounting onto the tip 8 of the nail gun 1. The front end 29 is preferably formed in a flat shape which also conforms generally to the front side of the nail gun tip 8.

In operation, when the nail gun 1 is intended for use to nail siding, particularly vinyl siding, onto the exterior wall of a building, the nail gun 1 is oriented to permit the installation of the adaptor 10 onto the discharge tip 8 of the nail gun 1. The shape of the adaptor 10 suggests the proper orientation of the adaptor 10 onto the tip 8. The recess 15 is shaped to receive the nail gun tip 8 into the recess 15 such that the distalmost portion of the discharge tip 8 is positioned adjacent to the floor 16 of the recess 15 and in alignment with the vertical discharge opening 20 of the adaptor 10. The set screws 19 are then tightened against the nail gun tip 8 to secure the adaptor 10 onto the nail gun 1. Then, the nail gun 1 can be powered and operated to drive nails 2 into the siding 9 by positioning the circular projection 25 over the upper lip of the siding 9 so that the circular projection 25 rests against the upper lip and locates the distal end of the circular projection 25 at the appropriate position, with the depth of the circular projection 25 being operable to place the distal face of the circular projection 25 proximate to the siding 9, for the insertion of a nail into the siding panel 9.

The movement of the nail from the nail gun 1 into the frusto-conical opening 20 formed into the circular projection 25 will occasionally be slightly misaligned with the smaller diameter discharge point of the opening 25. In such cases, the conical surface of the opening 20 from the floor 16 of the recess 15 to the distal end of the circular projection 25 will deflect the discharged nail sufficiently to enable the nail to pass through the opening 20 and into engagement with the siding panel 9. The depth of the circular projection 25 places the distal tip of the circular projection 25 against the siding panel 9 at the position where the insertion of the discharged nail is desired. Accordingly, the depth of penetration of the nail into the underlying building structure 9*c* is uniform and consistent and the nail is placed accurately each time the nail gun 1 is actuated.

The use of the nail gun 1 to attach siding panels 9 to a building as permitted by the use of the adaptor 10 provides a great advantage over the conventional practice of manually inserting nails into the siding 9. Not only does the nailing function require less human energy to perform, but the speed and efficiency of the nailing process is greatly increased, thus improving performance and reducing costs associated with the placement of siding onto a building exterior.

Removing the adaptor 10 from the tip 8 of the nail gun 1 is a simple matter of loosening the set screws 19 to allow the adaptor 10 to be pulled off of the tip 8. At this point, the adaptor 10 can be stored for subsequent use and the nail gun 1 can be utilized to perform functions other than nailing siding onto a building exterior. When the building process requires the installation of siding, the adaptor 10 can be quickly and easily installed, as defined above, to enable the nail gun 1 to be utilized in that capacity.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. An adaptor for mounting on a powered nail gun having a discharge tip to facilitate the use of the nail gun to install siding panels onto an exterior surface of a building structure, each siding panel having an upper lip structure and upper connective structure along an upper edge and a lower connective structure along a lower edge configured to interengage with the upper connective structure of an adjacent siding panel, comprising:

a body member having an upper surface, a lower surface and a side wall oriented perpendicularly to said lower surface and extending around said lower surface to define a perimeter of said body, said body having a front portion and a rear portion;

said body member being formed with a shaped recess into the upper surface, said recess having a floor and being shaped to conform to the discharge tip of said nail gun to permit said body member to be mounted onto said discharge tip with said discharge tip being positioned adjacent said floor of said recess; and a fixed diameter cylindrical projection extending below said lower surface and defining a stationary circular discharge opening for said adaptor, said discharge opening being in alignment with said discharge tip of said nail gun to permit the passage of nails discharged from the nail gun to pass through the body portion, said cylindrical projection being sized to engage said upper lip of said siding panel to position the discharged nail into said siding panel.

2. The adaptor of claim 1 wherein said discharge opening is a terminus of a passageway for the movement of nails through said cylindrical projection, said passageway being configured in a frusto-conical shape with a smaller diameter opening forming said discharge opening located at a distal end of said projection.

3. The adaptor of claim 2 wherein said side walls are formed with a threaded opening on opposing sides of said body member, said threaded openings being configured to receive set screws to secure said adaptor onto said discharge tip of said nail gun.

4. An adaptor for detachably mounting on a discharge tip of a powered nail gun, said adaptor being operable to facilitate the use of the powered nail gun to install siding panels onto a building structure, each siding panel having an upper lip structure, comprising:

a body member having an upper surface, a lower surface and a side wall oriented perpendicularly to said lower surface and extending around said lower surface and defining a perimeter of said body;

said body member being formed with a shaped recess into the upper surface, said recess having a floor and being shaped to conform to the discharge tip of said nail gun to permit said body member to be mounted onto said discharge tip with said discharge tip being positioned adjacent said floor of said recess; and a discharge passageway formed in a fixed diameter cylindrical projection extending from said floor of said recess and through said bottom surface, said discharge passageway being in alignment with said discharge tip of said nail gun to permit the passage of nails discharged from said nail gun through said adaptor, said discharge passageway being configured in a frusto-conical shape with a larger diameter of said frusto-conical shape being located at said floor to direct nails discharged from said nail gun through a distal smaller diameter of said frusto-conical shape defining a discharge opening at the terminus of said fixed cylindrical projection.

5. The adaptor of claim 4 wherein said fixed cylindrical projection is sized to engage said upper lip of said siding panel to position the discharged nail into said siding panel.

6. The adaptor of claim 5 wherein the exterior surface of said fixed cylindrical projection is circular in shape, said cylindrical projection including said frusto-conical discharge passageway internally thereof.

7. The adaptor of claim 6 wherein said side walls are formed with a threaded opening on opposing sides of said body member, said threaded openings being configured to receive set screws to secure said adaptor onto said discharge tip of said nail gun.

8. A method of attaching siding panels onto a building structure, each siding panel having an upper lip structure and upper connective structure along an upper edge and a lower connective structure along a lower edge configured to interengage with the upper connective structure of an adjacent siding panel, comprising the steps of:

detachably securing an adaptor onto a discharge tip of a powered nail gun, said adaptor having a body member configured to conform to the discharge tip, said body member including a fixed diameter cylindrical projection extending below a lower surface of said body member and defining internally of said cylindrical projection frusto-conical discharge passageway terminating in a discharge opening for said adaptor;

placing said circular projection into said upper connective structure in alignment with framework of said building structure;

discharging a nail from said powered nail gun through the discharge opening in said circular projection of said adaptor to secure the upper connective structure to said framework of said building structure;

displacing said nail gun along said upper connective strip to another point of alignment with said framework of said building structure; and further discharging another nail from said powered nail gun through said circular projection into said upper connective structure.

9. The method of claim 8 wherein the discharge opening in said fixed diameter cylindrical projection defines a smaller diameter opening of said frusto-conical passageway with a larger diameter opening being located at said lower surface of said body member.

10. The method of claim 9 wherein said securing step utilizes a pair of set screws engaged through threaded openings on opposing sides of said body member to receive said set screws and secure said adaptor onto said discharge tip of said nail gun.

* * * * *